US005218938A

United States Patent [19]

Miller et al.

[11] Patent Number: 5,218,938

[45] Date of Patent: Jun. 15, 1993

[54] STRUCTURAL OIL PAN FOR INTERNAL COMBUSTION ENGINE

[75] Inventors: William L. Miller, Huntington Woods; Terry L. Martin, Imlay City; William J. Carney, Brighton, all of Mich.

[73] Assignee: General Motors Corporation, Detroit, Mich.

[21] Appl. No.: 970,506

[22] Filed: Nov. 2, 1992

[51] Int. Cl.[5] ..... F02F 7/00

[52] U.S. Cl. ..... 123/195 H; 123/195 C

[58] Field of Search ..... 123/195 H, 195 C; 184/106

[56] References Cited

U.S. PATENT DOCUMENTS

| | | | |
|---|---|---|---|
| 2,647,494 | 8/1953 | Ware | 121/194 |
| 2,752,896 | 7/1956 | Emele | 121/194 |
| 2,969,779 | 1/1961 | Hauser | 121/194 |
| 3,202,463 | 8/1965 | Fatt | 308/23 |
| 3,300,256 | 1/1967 | Liebig | 308/23 |
| 3,782,792 | 1/1974 | Pfieiderer | 308/23 |
| 4,189,193 | 2/1980 | Schumacher | 308/23 |
| 4,327,679 | 5/1982 | Crouch et al. | 123/195 R |
| 4,453,509 | 6/1984 | Hayashi | 123/195 R |
| 4,466,401 | 8/1984 | Ogawa et al. | 123/195 H |
| 4,497,292 | 2/1985 | Hayashi et al. | 123/195 H |
| 4,520,770 | 6/1985 | Ogawa | 123/195 H |
| 4,958,602 | 9/1990 | Hoppner et al. | 123/195 C |

*Primary Examiner*—Noah P. Kamen

*Attorney, Agent, or Firm*—Karl F. Barr, Jr.

[57] ABSTRACT

The present invention discloses a structural oil pan for use with an internal combustion engine having a crankcase with short side walls of the type that generally do not extend below the center line of the crankcase. The oil pan has internal ribs which slidingly receive lower portions of the main bearing caps. The main bearing caps are fixed, relative to the oil pan with bolts passing through openings in the pan to threadingly engage corresponding openings in the bearing caps. Such an oil pan design allow the crankcase side walls, the crankshaft main bearing caps and the oil pan side walls to be structurally joined to resist vibration and noise generation. Weight savings are recognized by the oil pan of the present invention as the need for an engine block having extended side walls and increased weight is supplanted by a light weight, structurally rigid oil pan.

3 Claims, 1 Drawing Sheet

STRUCTURAL OIL PAN FOR INTERNAL COMBUSTION ENGINE

BACKGROUND OF THE INVENTION

1. Field of the Invention

This invention relates to internal combustion engine crankcase structures, and particularly, to a structural oil pan having a provision for cross bolting to the main bearing caps.

2. Description of the Relevant Art

Internal combustion engines of the reciprocating piston type may have crankcase structures, or blocks, in which the side walls of the block extend to the center line of the crankshaft. In such an instance, the port ion of the engine extending below the center line of the crankshaft is housed in the space established by the engine oil pan. To stiffen and strengthen crankcase castings, as may be required by high performance applications, the side walls may be extended below the center line of the crankshaft. In a deep side wall crankcase, the main bearing caps typically are slidingly engaged along their side edges by ribbed portions of the extended side walls. Cross bolting of the bearing caps through the extended side walls reduces torsional distortion and vibration.

In the case of cast iron engine blocks, the extension of the side walls to increase strength and reduce vibration and noise requires a corresponding increase in engine weight. Weight increases in automotive applications are undesirable due to the effect on efficiency. In addition, existing engine crankcases having standard length side walls cannot easily be transformed to longer side walls without significant redesign and retooling expense.

SUMMARY OF THE INVENTION

The present invention is directed to an oil pan configuration for use with an internal combustion engine having a crankcase construction featuring side walls which extend to the center line of the crankshaft but requiring the increased strength, rigidity, and noise and vibration damping which is inherent in a crankcase having side walls extending below the center line of the crankshaft. The oil pan disclosed presently is constructed of a light weight material such as an alloy of aluminum. The pan has an upper open end having a flanged surface for mating with the crankcase and a lower closed end which is connected to the upper end by webbed side walls. Strength and rigidity, which leads to lower radiated noise and vibration, is achieved through the use of webbing which extends about the exterior of the pan. Internal ribs are located and configured to slidingly engage the sides of the main bearing caps which extend below the lower end of the crankcase. Openings in the ribs, which extend through the sides of the oil pan, are aligned with threaded openings in the sides of the bearing caps. Fastening means such as bolts are used to structurally tie the crankshaft main bearing caps to the oil pan structure thereby achieving substantially the same benefit as extended crankcase side walls.

Of particular advantage in the present invention is the weight saving role of the structural oil pan over a crankcase designed with longer side walls. The structural oil pan is an equivalent to the extended crankcase side walls with respect to strength, rigidity and noise and vibration. However, the use of light metal alloys allows a significant weight savings over case iron, while allowing an added degree of design flexibility.

These and other features, objects, and advantages of the invention will be more apparent by reference to the following detailed description and to the drawings.

DESCRIPTION OF THE PREFERRED EMBODIMENTS

Figure 1:
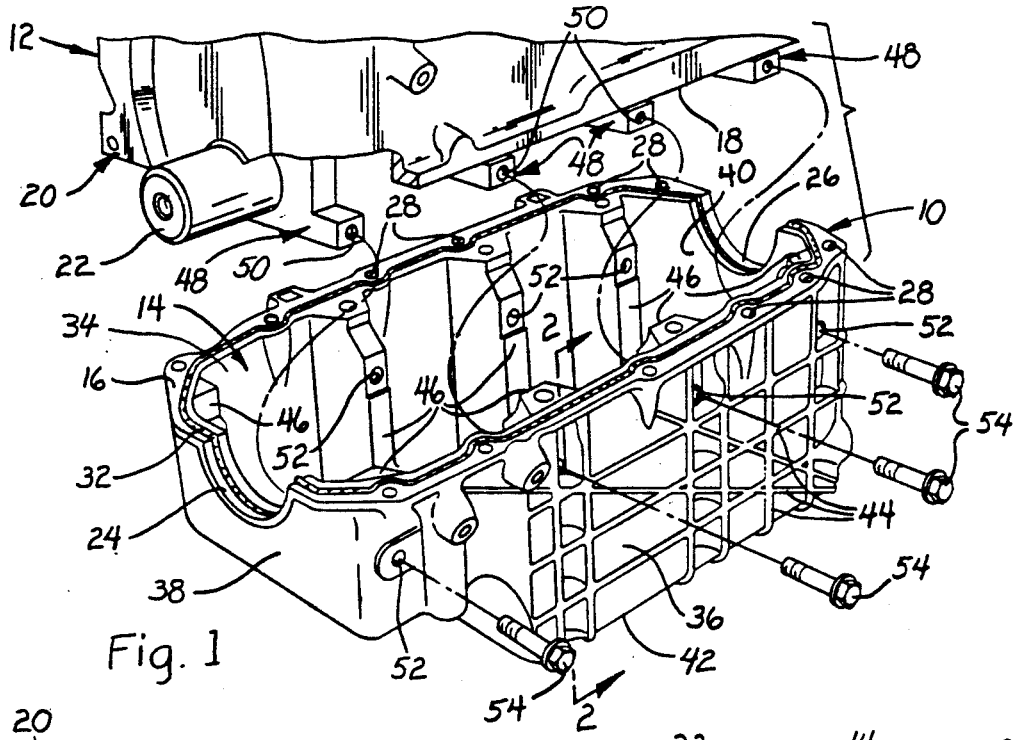
FIG. 1 is an exploded perspective view of the structural oil pan of the present invention relative to other engine components.

In FIG. 1 there is shown a structural oil pan, designated generally as 10, for use with an internal combustion engine 12. The structural oil pan 10 is constructed of cast material, such as an alloyed aluminum, or other suitable, light weight material and has an upper, open end 14 with a mounting flange 16 extending thereabout. The mounting flange 16 is configured to mate with a corresponding surface 18 of a crankcase 20. Since the crankcase 20 is of the type having side walls which extend only to the center line of the engine crankshaft 22, see FIG. 2, provision must be made in the oil pan mounting flange for clearance of the shaft. In the disclosed embodiment, arcuate depressions 24, 26 in flange 16 accommodate the crankshaft. Mounting holes 28 are spaced about the perimeter of flange 16 and accept mounting bolts 30 for mounting the oil pan 10 to the crankcase 20. A resilient sealing member, such as gasket 32, may be disposed between the flange 16 and mounting surface 18 of crankcase 20 to assure a fluid tight seal.

Oil pan sides 34, 36 and end portions 38, 40 extend from the upper open end 14 and terminate in a closed bottom 42. The sides and bottom of the oil pan 10 define a reservoir for the collection of oil used to lubricate the internal engine components during operation thereof. Strength and rigidity of the oil pan structure is achieved through the use of webs 44 which extend along the sides 34, 36, ends 38, 40, and bottom 42. The webs 44 allow the pan 10 to resist dimensional changes due to forces imparted on it by the engine while also allowing the use of thinner walls to reduce overall weight. Although the configuration of the oil pan 10 and the webs 44 shown in FIG. 1 is illustrative, it should be recognized that specific configurations may vary in each application.

Figure 2:
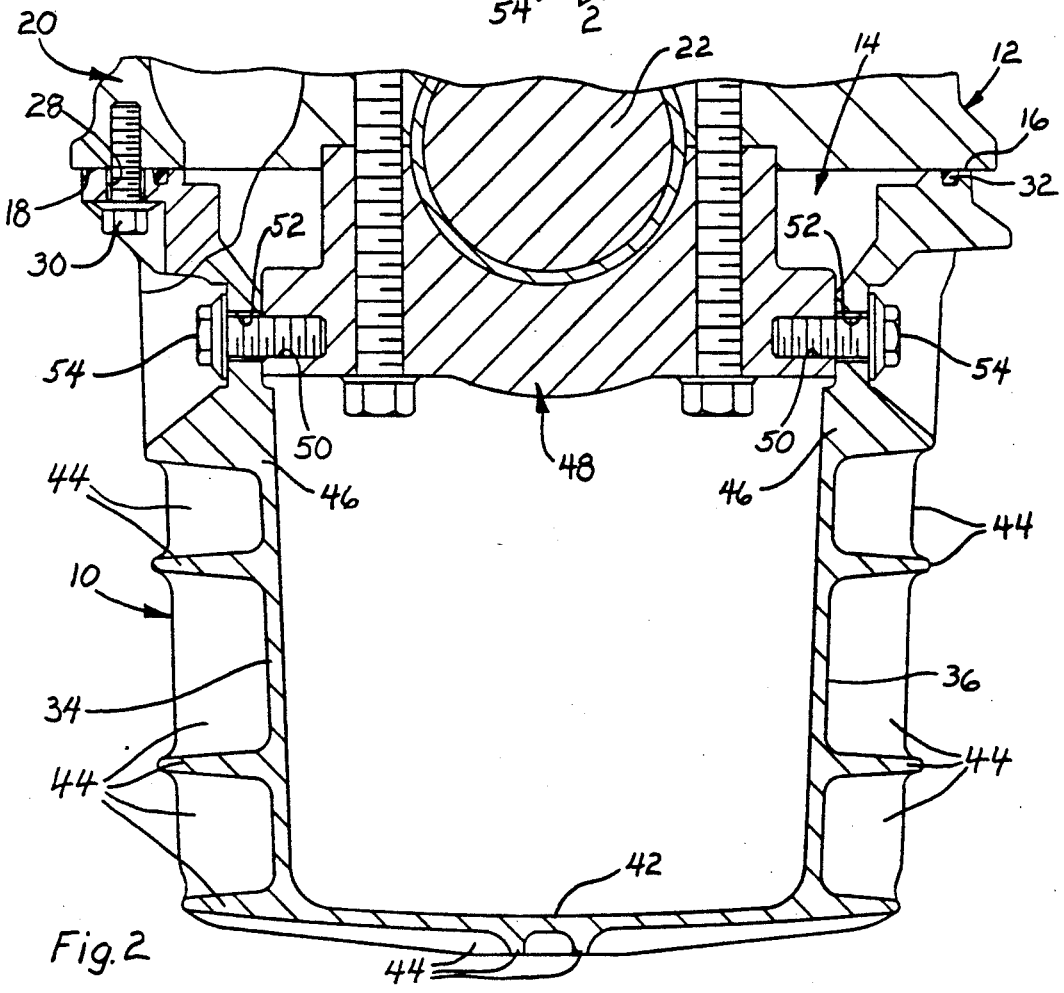
FIG. 2 is a sectional view of the assembled crankcase and oil pan of the present invention taken along line 2—2 of FIG. 1.

Rib members 46, formed integral with the inner surfaces of the oil pan sides 34, 36, extend from a location adjacent flange 16 toward the bottom 42 of the pan 10. The ribs 46 are located in opposing pairs and correspond to the location of each crankshaft main bearing cap 48 of the engine 12. As shown in FIG. 2, the ribs 46 are configured to engage the lower portions of the main bearing caps 48 which extend below the center line of the crankshaft as viewed in the Figures. The main bearing caps 48 have threaded openings 50 which align with corresponding openings 52 through the ribs 46 and sides 34, 36 of the oil pan 10. Upon fitting the structural oil pan to the crankcase 20, fastening means such as bolts 54 are passed through openings 52 to threadingly engage the threaded openings 50 of the main bearing caps 48, as illustrated in FIG. 1. Bolting the bearings through the structural oil pan in the manner described structurally integrates the side walls of crankcase 20, the structural oil pan 10, and the crankshaft main bearing caps 48 into a unitary structure. The structure is capable of reducing torsional distortions imparted to the bearing caps 48 by the crankshaft 22 thereby limiting vibration and noise radiation from the engine while avoiding the necessity of a heavier crankcase of the type having extended side walls.

The present invention discloses a structural oil pan for use with an internal combustion engine having a crank case with side walls of the type that generally do not extend below the center line of the crankcase. The oil pan has internal ribs which slidingly receive lower portions of the main bearing caps. The main bearing caps are fixed, relative to the oil pan by through-bolting the caps, with bolts passing through openings in the pan to threadingly engage corresponding openings in the bearing caps. Such an oil pan allows the crankcase side walls, the crankshaft main bearing caps and the oil pan side walls to be structurally joined to resist vibration and noise generation.

Weight savings are recognized by the oil pan of the present invention as the need for an engine block having extended side walls and increased weight is supplanted by a light weight, structurally rigid oil pan.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. An oil pan for use on an internal combustion engine comprising an open top having a flanged surface configured to sealingly engage a corresponding surface of the engine, a pair of side walls and a pair of end walls extending from said open top and closed by a bottom to define a reservoir, said side walls and end walls having webs extending along the outer surfaces thereof and having pairs of ribs extending along the inner surfaces thereof, said ribs corresponding in number and location to the number and location of the crankshaft main bearing caps of said engine and configured to slidingly engage said main bearing caps upon joining said oil pan to the engine, said oil pan further comprising openings extending through said side walls and in alignment with threaded openings in the crankshaft main bearing caps engaged in said oil pan ribs, and fastening means engageable through said openings and in the threaded openings in the main bearing caps to structurally tie said oil pan to the lower end of the engine and to the crankshaft main bearing caps.

2. An oil pan for use on an internal combustion engine having side walls terminating at the crankshaft center line and having crankshaft main bearing caps extending below the center line of said crankshaft, said oil pan comprising an open top having a flange extending about the perimeter thereof and configured for fixed, sealing engagement with the engine side walls, a pair of side walls and a pair of end walls extending from said open top and closed by a bottom wall to define an oil reservoir therein, said walls having strengthening webs extending about the outer surfaces thereof, said side walls further having pairs of ribs extending along the inner surfaces thereof from a location substantially adjacent to said open top towards said bottom wall and corresponding in number and location to the crankshaft main bearing caps, said ribs configured to slidingly engage the lower portions of the crankshaft bearing caps upon joining said oil pan to the engine, and openings extending through said side walls at said rib locations in alignment with threaded openings in said bearing caps engageable through said openings with fastening means to structurally tie said oil pan to the sides of the crankshaft main bearings of the engine.

3. An oil pan for use on an internal combustion engine comprising an open top, a pair of side walls, a pair of end walls, and a bottom end cooperating to form an oil reservoir, said top end configured for sealing engagement with the engine and said side walls having openings extending therethrough for the passage of fastening means, said fastening means engaging threaded openings in the sides of the engine crankshaft main bearing caps to structurally integrate said oil pan to the sides of said crankshaft main bearing caps of said engine.

* * * * *